United States Patent [19]

Bessho et al.

[11] Patent Number: 4,933,657

[45] Date of Patent: Jun. 12, 1990

[54] EDDY CURRENT TYPE MULTILAYERED COIL FOR GENERATING INTENSE AC MAGNETIC FIELD

[75] Inventors: Kazuo Bessho, Kanazawa; Masato Enokizono, Ohita, both of Japan

[73] Assignee: Kanazawa University, Kanazawa, Japan

[21] Appl. No.: 386,613

[22] Filed: Jul. 31, 1989

[30] Foreign Application Priority Data

Aug. 8, 1988 [JP] Japan ..... 63-196072

[51] Int. Cl.[5] ..... H01F 5/00

[52] U.S. Cl. ..... 335/299; 335/296

[58] Field of Search ..... 335/243, 250, 296, 299

[56] References Cited

U.S. PATENT DOCUMENTS

| | | | |
|---|---|---|---|
| 3,439,305 | 4/1969 | Klein | 335/299 |
| 4,745,387 | 5/1988 | Aubert | 335/299 |
| 4,774,487 | 9/1988 | Aubert | 335/299 |
| 4,808,956 | 2/1989 | Aubert | 335/299 |

*Primary Examiner*—George Harris

*Attorney, Agent, or Firm*—Spencer & Frank

[57] ABSTRACT

In circular conductor plates having radial slits alternately stacked with spirally wound coils continuously connected in order and supplied with comparatively low frequency AC current, eddy currents generated in peripheral direction are concentrated along the radial slits around central holes of the conductor plates, so as to induce concentrated AC magnetic fluxes in those holes. As a result, an intense AC magnetic field can be efficiently obtained by a comparatively small driving AC current in comparatively low frequency range.

1 Claim, 4 Drawing Sheets

EDDY CURRENT TYPE MULTILAYERED COIL FOR GENERATING INTENSE AC MAGNETIC FIELD

BACKGROUND OF THE INVENTION

1. Field of the Invention

The present invention relates to an eddy current type multilayered coil for generating an intense AC magnetic field, which generates an intense AC magnetic field used for technological research of magnetic properties, power magnetics, biomagnetics, nuclear fusion and the like, more particularly, which is improved so as to be readily manufactured with an extremely simple structure and to facilitate the use in a low frequency range such as for commercial use.

2. Description of the Prior Art

In general, as for the intense magnetic field generators, the research and the development of such generators is strongly reused to progress by employing large-scale arrangement, which are utilized for the research of material properties in such intense magnetic fields; the development of new manufacturing materials, experiments in nuclear fusion, and the like.

The conventional intense magnetic field generators of this kind can be roughly classified into three groups, that is, destructive intense pulse magnetic field generators such as those of KNER method and implosion method, non-destructive intense pulse magnetic field generators such as those of a multilayered coil type and MIT type, and continuous intense magnetic field generators such as those of a superconductive type and hybrid type.

Those conventional generators are indeed very effective for providing extremely intense magnetic fields. However, those have various defects such that the time duration of intense magnetic fields generated is very short, that special facilities such as extremely low temperature apparatus and large power sources are required and further that only pulse or a DC magnetic field can be provided and hence intense AC magnetic fields cannot be continuously generated. On the other hand, the study of biomagnetics has progressed and the needs for the investigation of the relation between the live body and AC magnetic fields has been increased, and hence there is demand for the development of an intense AC magnetic field generator.

Against the above defects, the inventors have disclosed multilayered eddy current type intense AC magnetic field generators in their U.S. Pat. application Ser. Nos. 160,294 now U.S. Pat. No. 4,857,874 and 160,295 now Pat. No. 4,855,703 (European Patent Application No. EPC88301643.8 and EPC88301644.6) Specifications. In these disclosed intense AC magnetic field generators, according to a novel efficient magnetic flux concentration system in which eddy currents generated in conductors by supplying AC currents through coils are concentrated around holes provided in central portions of those conductors. In order to reduce the leakage of magnetic flux, the hole is provided in the central portion of the circular conductor plate, while cylindrical and annular branches extending in the axial and the radial directions respectively are provided in the peripheral portion thereof. A conductor plate thus formed is further provided with a slit extending from the central hole to the periphery of the plate in a radial direction, and eddy current exciting coils are separately inserted between each of axial and annular branches respectively. In these structures, eddy currents generated in each of the branches by supplying AC currents through each of the inserted coils are concentrated around the central hole, and hence high density AC magnetic fluxes are induced by the concentration of these eddy currents in the central hole, so as to facilitate the continuous generation of an intense AC magnetic field.

However, in these multilayered eddy current type intense AC magnetic field generators, the structure of the eddy current generating conductors is complicated and further, the eddy current inducing coils are formed of conventional wire wound type coils, so that it is difficult to manufacture those generators of a large scale.

Accordingly, the inventors have disclosed an eddy current type multilayered coil for generating intense AC magnetic field in their U.S. Pat. application No. 307,524 now U.S. Pat. No. 4,879,539 (West German patent application No. P3906908.7). As to this coil for generating an AC magnetic field, the structure is extremely simple and hence readily manufactured, the eddy current exciting coil being provided with low impedance, the eddy current generating conductor is thin with a reduced skin effect, and the obtainable magnetic field intensity is extremely higher than the conventional coil of this kind.

In this disclosed eddy current type multilayered coil, the eddy current exciting coil is formed of a spiral conductor plate, between each of the layers of which annular conductor plates are inserted which individually have respective slits extending from central holes to the peripheries of the plates and are insulated therefrom. Such a spiral conductor plate is divided into layers, so as to be readily manufactured with each of the layers insulated from each other by the slitted annular conductor plates and stacked in a cylindrical form, and then spirally connected with each other.

In particular, as shown in FIG. 1, circular conductor plates 1*a*, 1*b*, . . . , individually having wide fan-out slits extending from respective central holes to the peripheries of the plates and annular conductor plates 4*a*, 4*b*, 4*c*, . . . , individually having radial slits, are alternately stacked together with annular insulator plates having slits (not shown) being inserted therebetween such that respective slits substantially coincide with each other. The annular conductor plates 4*a*, 4*b*, 4*c*, . . . , in each layer of the stacked conductor plates are connected with each other in order such that, for instance, one end of the annular conductor plate 4*a* is connected with the other end of the annular conductor plate 4*b*, so as to form a continuous spiral conductor coil which excites sufficient numbers of eddy current generating circular conductor plates (stacked in a shape of a cylinder 14 as shown by dashed lines) for obtaining an AC magnetic field having a required intensity in a required space. In the example, eddy currents 8, 9, 10, . . . , are generated respectively in circular conductor plates 1*a*, 1*b*, . . . , by supplying an AC current 7 through the continuous spiral conductor coil 4*a*-4*b*-4*c*- . . . and hence high density magnetic fluxes are concentrated in a central hole 2.

However, the above previously disclosed eddy current type multilayered coil fo rgenerating AC magnetic field is suited for the use of low voltage and a large current in a comparatively high frequency range because of the structure of the spiral conductor plate coil, and hence it is feared that the range of its application may be restricted to some degree. In this case, a power source such as a transformer for the use of low voltage and large current is required, and hence the function of a wide-frequency-ranged and multi-purposed intense AC magnetic field generator cannot be attained.

The removal of the restriction of the range of use is a problem in the art for the eddy current type multilayered coil of this kind.

SUMMARY OF THE INVENTION

An object of the invention is to provide an eddy current type multilayered coil for generating an intense AC magnetic field which has a high efficiency and a simple structure to enable it to be readily manufactured, and which is suitable for the application of high voltage and small current in a comparatively low frequency range.

Another object of the invention is to provide an eddy current type multilayered coil for the application of high voltage and small current in a comparatively low frequency range and which functions as a pair of intense AC magnetic field generators which available for multipurpose uses in a wide frequency range together with the previously disclosed eddy current type multilayered coil for the application of low voltage and large current in a comparatively high frequency range.

Accordingly, an eddy current type multilayered coil for generating an intense AC magnetic field of the present invention is characterized in that, in a case individual constituents are formed in a circular shape, eddy current generating conductor plates having respective slits extending from central holes to peripheries of the plates, and eddy current conductor coils formed individually of conductor strips wound in flat annular shapes are alternately stacked together with radially cut annular insulator plates individually inserted therebetween, one end of each of said conductor coils being connected in order with the other ends of adjacent conductor coils, so as to form a continuous eddy current exciting conductor coil, such that eddy currents individually generated, in the conductor plates in peripheral directions by supplying an AC current through the continuous conductor coil concerned, are concentrated around respective central holes along respective slits, so as to induce AC magnetic fluxes concentrated through the respective central holes.

Accordingly, the eddy current type multilayered coil of the present invention has a simple structure consisting of stacked circular plate constituents similar to previously disclosed coils of this kind. A variable frequency type intense AC magnetic field generator having excellent mechanical strength and permitting ready cooling thereof is available in the wide frequency range and in the wide technical fields such as the research of material properties, the research of biomagnetics, the development of novel materials, magneto-electrical pumps and nuclear fusion.

BRIEF DESCRIPTION OF THE DRAWING

For a better understanding of the invention, reference is made to the accompanying drawings, in which.

DESCRIPTION OF THE PREFERRED EMBODIMENT

The present invention will be described in detail for a preferred embodiment by referring to the accompanying drawings.

Figure 1:
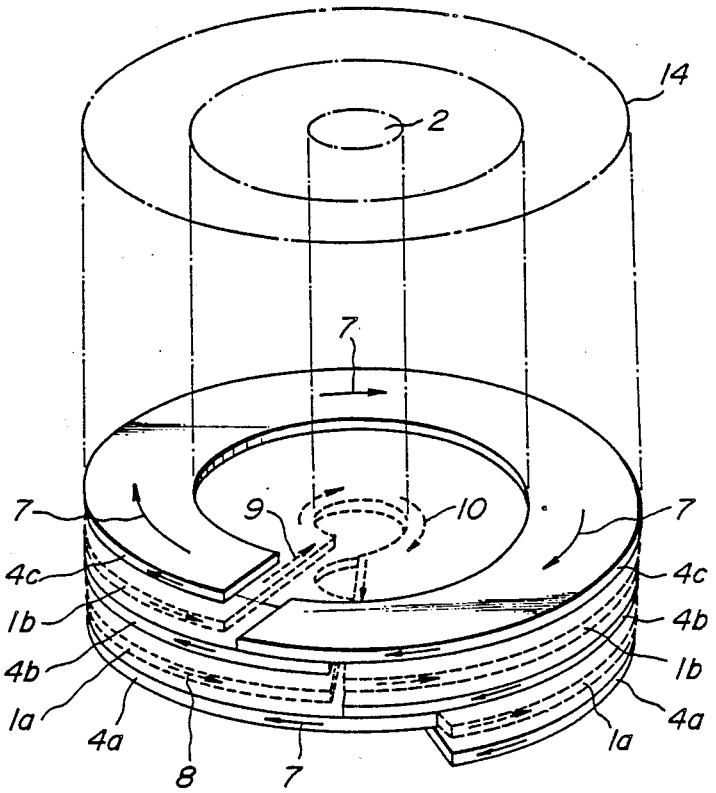
FIG. 1 PRIOR ART
FIG. 1 is a perspective view showing an example of a multilayered structure of a conventional eddy-current type multilayered coil for generating an intense AC magnetic field.
Figure 2:
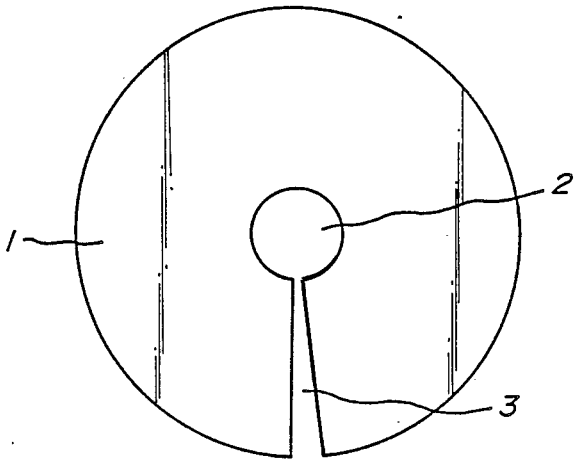
FIG. 2 is a plan view showing an example of a structure of an eddy current generating circular conductor plate having an eddy current type multilayered coil according to the present invention.

Firstly, FIG. 2 shows an example of a structure of a circular conductor plate which composes the most important portion of the eddy current type multilayered coil of the present invention for generating an eddy current so as to form a concentrated magnetic flux. The circular conductor plate 1 as shown in FIG. 2 is provided with an appropriately sized hole 2 at the central portion thereof, from which a slit 3 extends in a radial direction.

Figure 3:
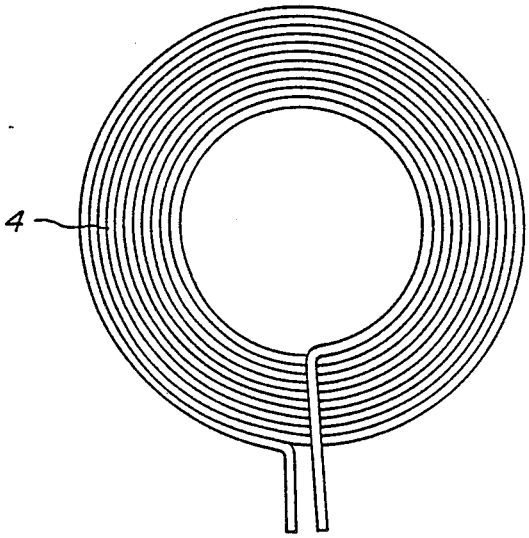
FIG. 3 is a plan view showing an example of a structure of an eddy current exciting conductor coil of the present invention.
Figure 4:
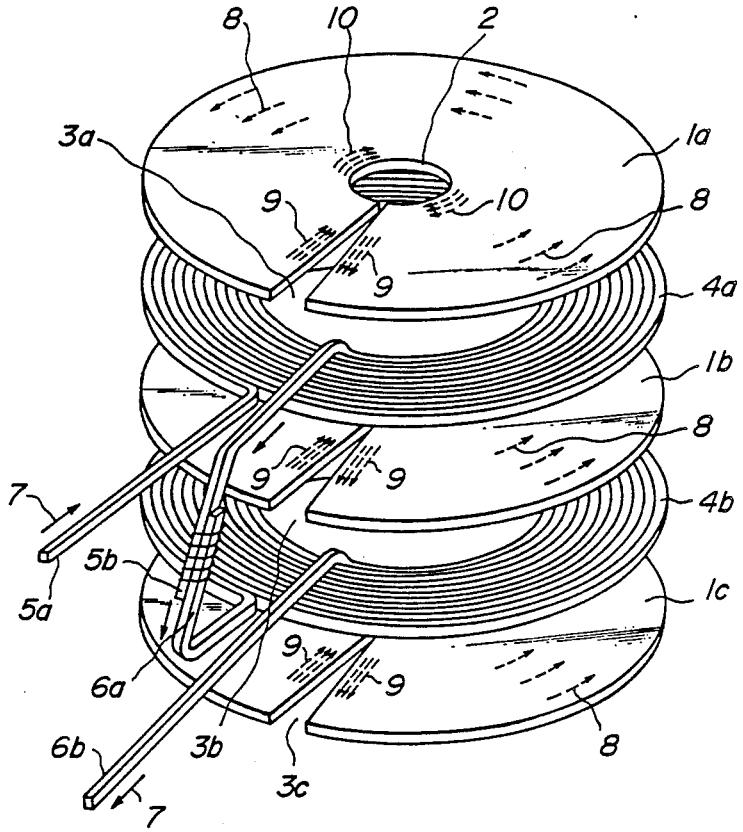
FIG. 4 is a perspective view showing an example of a multilayered structure of the eddy current type multilayered coil of the present invention.

An eddy current exciting coil which is alternately stacked with the above-mentioned circular conductor plate 1 so as to generate an eddy current in the peripheral direction of the periphery thereof is formed as shown in FIG. 3. The eddy current exciting flat annular conductor coil 4 as shown in FIG. 4 is formed by spirally winding conductor strip, which has an appropriate cross-sectional shape such as square or circular, in the annular shape corresponding to the peripheral portion of the above-mentioned circular conductor plate 1. According to this structure, the coil of the present invention has a high impedance in comparison with the annular conductor plates 4*a*, 4*b*, 4*c*, . . . , of the previously disclosed eddy current type multilayered coil and is suitable for exciting the eddy current in the peripheral portion of the circular conductor plate 1 by supplying the small AC current at a high voltage in a comparatively low frequency range. Thus, the respectively formed circular conductor plates 1 and the flat annular conductor coils 4 are alternately stacked in a coaxial cylindrical shape similar to the previous coil as shown in FIG. 2 by a number of layers sufficient for generating an AC magnetic field of a required intensity in a desired space, so as to provide an eddy current type multilayered coil of the present invention as shown in FIG. 4 (in which each of the layers are shown as separated from each other for better understanding.)

Figure 5:
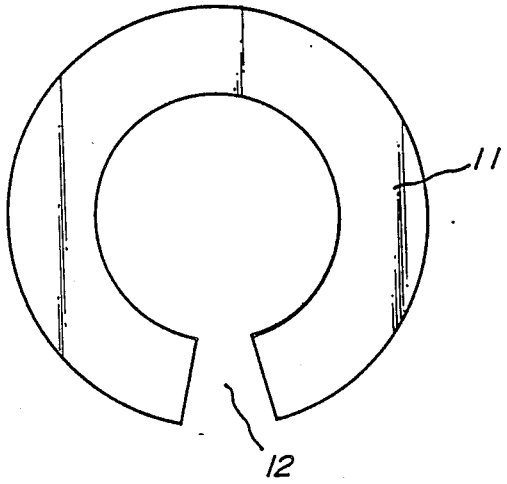
FIG. 5 is a plan view showing an example of a structure of an annular insulator plate having an eddy current type multilayered coil according to the present invention.

In this connection, although not shown in FIG. 4, in a manner similar to the previously disclosed eddy current type multilayered coil of this kind in that annular insulator plates 11 having respective fan-shaped slits 12 as shown in FIG. 5 are individually inserted between each of the circular conductor plates 1*a*, 1*b*, 1*c* and each of the flat annular conductor coils 4*a*, 4*b*, so as to effect electrical insulation therebetween.

In the exemplified structure as shown in FIG. 4, a continuous eddy current exciting coil is formed by connecting an end 5*b* of a flat annular conductor coil 4*a* and an end 6*a* of an adjacent flat annular conductor coil 4*b* with each other in order and an AC current is supplied through the thus formed continuous coil by applying an AC voltage of respectively appropriate frequency and voltage between both ends 5*a* and 6*b* thereof. As a result, AC magnetic fluxes are generated through central holes by the AC currents 7, while eddy currents 8 generated in peripheral portions of the respectively adjacent circular conductor plates 1*a*, 1*b*, 1*c*, induced by the magneto-electric function of the exciting current 7 in a direction contrary to that of the exciting currents 7, flow in the peripheral direction and then turn along the slits 3*a*, 3*b*, 3*c*, so as to form radial direction eddy currents 9 which are concentrated around the central holes 2 and result in eddy currents 10 flowing in the same direction as the exciting currents 7. As a result, AC magnetic fluxes induced by the concentrated eddy currents 10 pass through the central holes 2, so as to form an intense AC magnetic field consisting of high density magnetic fluxes.

In this connection, the magnetic fluxes induced in the holes 2 by the concentrated eddy currents 10 are generated in the same direction as those induced by the exciting current 7, so that these two groups of the magnetic fluxes are superposed with each other so as to concentrate the induced magnetic fluxes 13 passing through the holes 2 and hence further increase the obtainable intensity of the AC magnetic field.

Figure 6:
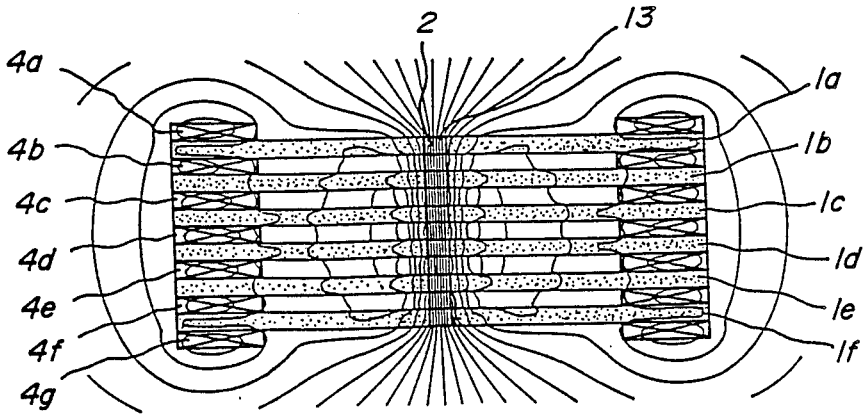
FIG. 6 is a vertical sectional view showing a manner of the concentration of magnetic flux induced in the eddy current type multilayered coil of the present invention.

An example of the manner of concentration of the induced magnetic fluxes as mentioned above is shown in FIG. 6. In this manner as shown of the concentration of the magnetic flux, concentration, the eddy currents 8 to 10 are generated respectively in the circular conductor plates 1*a* to 1*f* by the exciting current 7 flowing respectively through the flat annular conductor coils 4*a* to 4*g* stacked alternately with those circular conductor plates 1*a* to 1*f*, and hence the concentrated eddy currents 10 flow around the holes 2. As a result, all of the magnetic fluxes induced by these concentrated eddy currents 10 flow through the holes 2 and are concentrated, as well as magnetic fluxes induced by an exciting current 7 proper flowing through the flat annular coils 4*a* to 4*g* which pass through those holes 2 partly as shown in FIG. 6, so that the density of the magnetic fluxes passing through the holes 2 is extremely increased, so as to obtain an intense AC magnetic field.

As is apparent from the above description, the intense AC magnetic field generator using the eddy current type multilayered coil of the present invention can not only be readily manufactured because of its simple structure which is similar to the previously disclosed eddy current type multilayered coil of this kind, but also can attain the following various evident effects:

(1) The spiral coils can be formed by any number of windings having interleaved sheets. in order to obtain the intense AC magnetic field of desired intensity.

(2) The eddy current generating circular conductor plates are individually inserted between each layer of the stacked spiral coils, so that the impedance of the spiral coil is reduced, such that a large exciting current flows in comparison with the voltage of the AC voltage applied to the spiral coil eddy current is induced in the direction opposite to the exciting current generated in the peripheral portion of the circular conductor plate by this large exciting current and is prevented from completing a path entirely in the circumferential direction by the slit and hence is concentrated around the central hole; thereof, the magnetic flux induced by this concentrated eddy current, is efficiently concentrated in the hole, so as to form an intense AC magnetic field of extremely high magnetic flux density in the hole.

(3) The eddy current generating circular conductor plate, which realizes the highly efficient intense AC magnetic field generator based on a simple structure which includes the circular conductor plates 1*a*–1*f*-stacked alternately with exciting conductor coils 4*a*–4*g*, is applied with a strong magnetic force in the vicinity of the central hole thereof. However, a special copper alloy having a large mechanical strength can be used for the material thereof, and moreover the overheating of the multilayered coil which is caused by the eddy current concentrated around the hole, can be comparatively readily prevented by a cooling means based on a simple structure having stacked circular plates.

(4) When the eddy current type multilayered coil of the invention is fed by a power source of variable frequency, a variable frequency type intense AC magnetic field generator can be realized by the coil concerned as it is, and, when fed by a pulsive power source, it can be employed as an intense pulse magnetic field generator.

(5) The eddy current type multilayered coil of the invention which is used for high voltage and small current at a comparatively low frequency, in combination with the previously disclosed eddy current type multilayered coil which is used for low voltage and large current at a comparatively high frequency, can function as a multi-purpose intense AC magnetic field generator.

In the above description, an example of the coil of the invention having constituents which are shaped in the preferred shape of a circle is disclosed. However, if required, any other shape such as an ellipse, a square and a polygon can be naturally used with the almost same effect and the same attainable purpose.

What is claimed is:

1. An eddy current type multilayered coil for generating an intense AC magnetic field, characterized in that eddy current generating conductor plates having respectively slits extended from central holes to peripheries and eddy current conductor coils formed individually of conductor strips wound in flat annular shape are alternately stacked together with radially cut annular insulator plates individually inserted therebetween, one ends of said conductor coils being connected in order with the other ends of the adjacent conductor coils, so as to form a continuous eddy current exciting conductor coil such as eddy currents individually generated in the conductor plates in peripheral directions by supplying an AC current through the continuous conductor coil concerned are concentrated around respective central holes along respective slits, so as to induce AC magnetic fluxes concentrated through the respective central holes.

* * * * *